US006732680B1

(12) United States Patent
Beltramo et al.

(10) Patent No.: US 6,732,680 B1
(45) Date of Patent: May 11, 2004

(54) INTERNAL COMBUSTION ENGINE WITH LIQUID COOLANT PUMP

(75) Inventors: Joel John Beltramo, West Bloomfield, MI (US); Ted Leo Byers, Ann Arbor, MI (US); William Francis Gubing, III, Canton, MI (US); Chris Donald Wicks, Allen Park, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/248,601

(22) Filed: Jan. 31, 2003

(51) Int. Cl.[7] ..... F01P 5/10
(52) U.S. Cl. ..... 123/41.44; 415/193; 415/209.1
(58) Field of Search ..... 123/41.44; 415/191, 415/193, 194, 208.2, 209.1

(56) References Cited

U.S. PATENT DOCUMENTS

| | | | | |
|---|---|---|---|---|
| 1,782,073 A | * | 11/1930 | Piquerez | 123/41.44 |
| 4,213,745 A | | 7/1980 | Roberts | |
| 5,096,382 A | | 3/1992 | Gratzer | |
| 5,611,677 A | | 3/1997 | Salama | |
| 6,267,554 B1 | | 7/2001 | Heer | |

* cited by examiner

*Primary Examiner*—Noah P. Kamen

(57) ABSTRACT

An internal combustion engine includes a coolant pump having an axially directed rotary pumping element which is functionally housed between upstream and downstream stators which function to straighten the flow and recover fluid velocity, both before and after work has been performed on the fluid by the rotary pumping element.

17 Claims, 3 Drawing Sheets

Figure 3
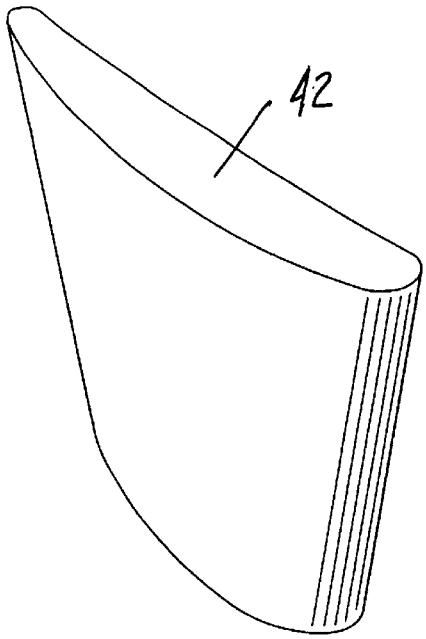
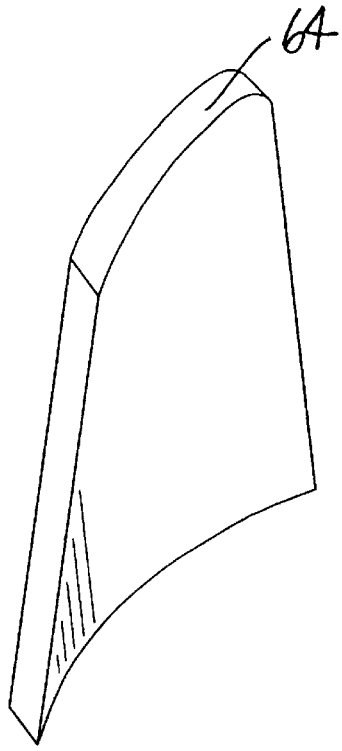
Figure 4

INTERNAL COMBUSTION ENGINE WITH LIQUID COOLANT PUMP

BACKGROUND OF INVENTION

1. Field of the Invention

The present invention relates to a pump for circulating coolant between a radiator and the cylinder block of an automotive internal combustion engine.

2. Disclosure Information

Automotive designers have gravitated toward centrifugal pumps for automotive engines. Such pumps are characterized in part by the placement of their fluid inlets and outlets along the radial edge of a centrifugal impeller. Centrifugal pumps are typically difficult to package because of their large size, and they are relatively inefficient because of the large amount of power needed to perform work on the coolant. Moreover, it is difficult to change the flow output, in other words, the volume and pressure of the flow, without expensive redesigning of the impeller and its housing. U.S. Pat. No. 1,370,823 discloses a water pump and aerator for a cooling system of an engine in which a multiple propellers are used with some having air inlets to entrain atmospheric air into the liquid coolant. The pump of the '823 Patent does not have inlet and outlet flow control stators covering substantially the entire flow channel and the discharged fluid, as with the intake fluid flows with a mixed flow and this pump would therefore be expected to operate at only minimum efficiency.

SUMMARY OF INVENTION

The inventors of the present automotive coolant pump have determined that an efficient pump may be constructed with a mixed flow transition section followed by a transitional stator in advance of an axial propeller, which is itself flowed by a flow regenerator so as to allow the fluid to be discharged in a purely axial direction. A pump according to the present invention will overcome problems noted with both centrifugal pumps and the pump of the '823 Patent.

An internal combustion engine includes a cylinder block structure, a coolant intake port formed in the cylinder block structure, a radiator, and a liquid coolant pump mounted to the cylinder block structure for moving coolant from the radiator into the coolant intake port. The coolant pump comprises an inlet connected with the radiator, and an axially-directed rotary pumping element for producing an axially-directed flow of coolant, with the rotary pumping element being attached to a sealed driveshaft. An upstream transitional stator is mounted proximate rotary pumping element, between the pumping element and the inlet. This upstream stator straightens the flow entering through a transitional mixed flow section extending between the inlet and the upstream transitional stator. After passing through the rotary pumping element, the flow passes through a downstream flow straightening stator mounted proximate to rotary pumping element between the pumping element and the coolant intake port. The upstream and downstream stators preferably comprise unitary structures, with each having a plurality of curved vanes attached to a common hub and terminating in a common peripheral ring shroud. The downstream flow straightening stator functions as a flow regenerating stator which recovers momentum directed in non-axial directions and converts non-axial motion of the fluid to axial motion with increased pressure and velocity. Each of the stators uses curved vanes rather than straight vanes. The stators may comprise stamped or cast structures made of metals or plastic composites.

A coolant pump according to the present invention may be powered directly by an engine, such as by the engine's crankshaft or camshaft, or could be powered by an electric motor or hydraulic motor attached to the drive shaft extending through the pump and mating with a common hub which is junction for a plurality of curved blades for the rotary pumping element, or propeller, with the blades terminating in a common peripheral ring shroud.

According to another aspect of the present invention, a method for providing liquid coolant to an internal combustion includes the steps of drawing coolant from a radiator into a coolant pump, passing the coolant through a mixed flow transition section within the pump and thereby changing the flow from primarily a radially directed flow to primarily an axially directed flow, and then passing the coolant through a transitional stator to increase the axially directed flow component. Then, work is performed upon the coolant with an axially directed, rotary pumping element and the coolant is then passed through a flow regenerator to increase the axially directed flow component. Finally, the coolant is passed into a coolant intake port formed in a cylinder block structure of an engine.

It is an advantage of a coolant pump according to the present invention that an engine may be equipped with a pump which performs more efficiently and with lower power consumption.

It is a further advantage of the present invention that flow leaving a coolant pump according to the present invention will be primarily axially directed and will flow into an engine at higher velocity and greater pressure than is possible with conventional automotive centrifugal coolant pumps.

It is a further advantage of the present invention that a coolant pump according to this invention will function at a lower noise level than known coolant pumps.

It is a further advantage of the present invention that a coolant pump according to this invention may be made of non-metallic materials providing superior durability, as well as cost advantages.

It is a further advantage of the present invention that a coolant pump according to this invention may be easily reconfigured to revise the pump's operating characteristics, such as the flow volume and output pressure, by changing the shape, pitch, and number of blades on the pump's propeller.

Other advantages, as well as objects and features of the present invention, will become apparent to the reader of this specification.

BRIEF DESCRIPTION OF DRAWINGS

FIG. 3 is a propeller blade from a rotary pumping element according to the present invention.

FIG. 4 is a stator blade from a coolant pump according to the present invention.

DETAILED DESCRIPTION

Figure 1:
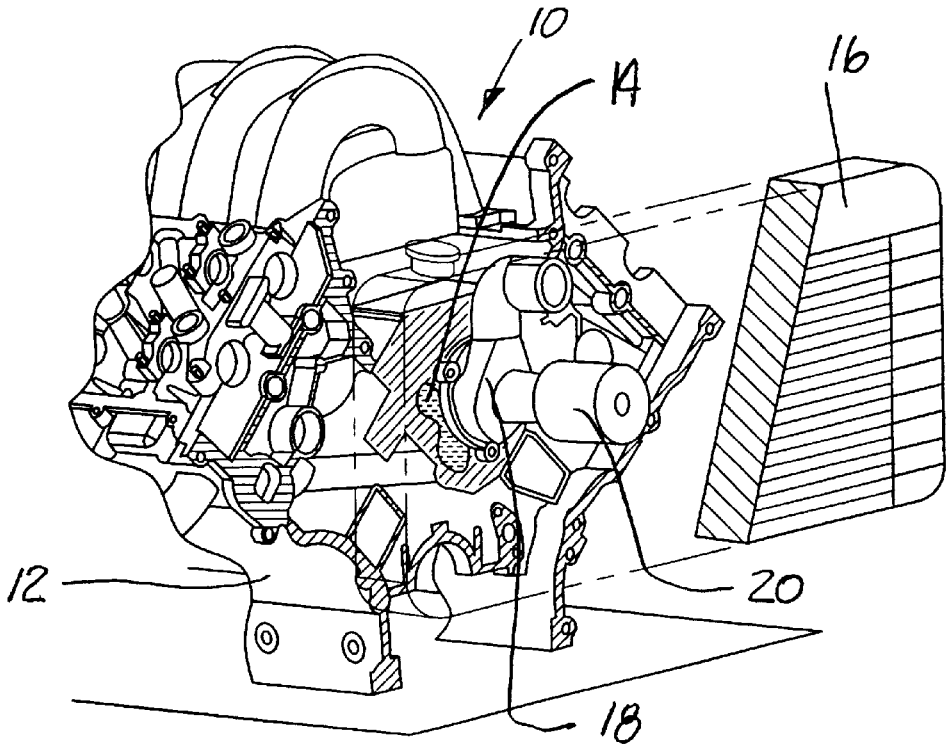
FIG. 1 shows a typical internal combustion engine having a coolant pump according to the present invention.

As shown in FIG. 1, engine 10, which is illustrated as a V-block engine, has cylinder block 12 with coolant intake 14, radiator 16 and coolant pump 18. Those skilled in the art will appreciate in view of this disclosure that a coolant pump according to the present invention could be employed with other types of engines including inline engines and other types of liquid cooled engines.

Figure 2:
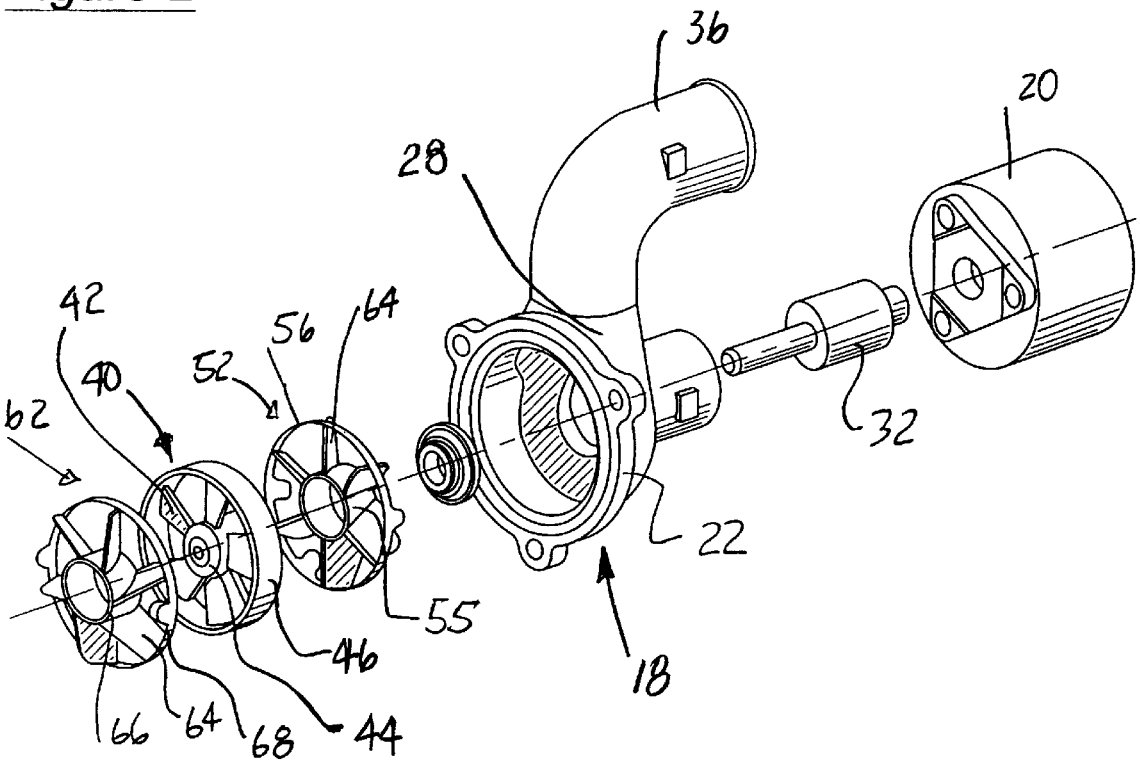
FIG. 2 is an exploded perspective view of a coolant pump according to the present invention.

FIG. 2 illustrates the component parts of the present cooling system pump 18. The pump is driven by pump drive 20 which may comprise either a drive belt connected solely between pump drive shaft 26 and the engine's crankshaft (not shown), or by other belt or gear arrangements driven by the crankshaft or camshaft of the engine. Furthermore, pump drive 20 could comprise an electric motor, powered by a vehicle's electrical system or a hydraulic motor powered by a pump such as a power steering or transmission pump. These and other sorts of drives known to those skilled in the art would be suggested by this disclosure.

Pump 18 has housing 22, with driveshaft 26 inserted axially therein. Driveshaft 26 has bearing and seal assembly 32, which allows driveshaft 26 to be rotated without allowing the escape of pressurized coolant from the front of pump 18. Liquid coolant entering inlet 36, which is connected with radiator 16, first enters mixed flow transition section 28, where the fluid flow is converted from predominantly radially directed flow to predominantly or primarily an axially directed flow. The final direction of the flow is performed by upstream transitional stator 52, which has a plurality of curved blades as illustrated in FIG. 4. Each of blades 64 is attached to a central hub 55 at one end, and to a common peripheral ring shroud 56 at the other end. Upstream transitional stator 52 as noted above, straightens the flow and increases the axially directed flow component. In other words, the velocity of the flow in the axial direction which is parallel to the center line of driveshaft 26, is increased.

Upon leaving upstream transitional stator 52, the flow encounters propeller 40, which includes a plurality of blades 42 having a profile as illustrated in FIG. 3. It is understood that FIG. 3 is a wire-frame drawing of the blades suitable for use on propeller 40, which is a type of axially directed rotary pumping element. Those skilled in the art will appreciate in view of this disclosure that blades having other types of profiles could be employed within axial directed rotary pumping element according to the present invention.

Propeller 40 as noted above, has a plurality of blades 42 with each of the blade having a first inner end attached to a central hub 44, and an outboard end attached to ring shroud 46. Those skilled in the art will appreciate in view of this disclosure that other types of propeller configurations producing axially directed flows could be employed with a pump according to the present invention.

Upon leaving axially directed pumping element 40, coolant encounters downstream flow straightening stator 62, which contains a plurality of curved blades 64 attached to a central hub 66, and which has a ring shroud 68. Stators 52 and 62 may be formed as unitary structures from stamped metal or plastic or other materials suitable for stamping, or could be cast from metals or non-metallic materials such as plastic composite. In any event, it is expected that the stators will have blades of the configuration shown in FIG. 4 or some other types of configuration known to those skilled in the art and suggested by this disclosure.

The purpose of downstream flow straightening stator 62 is to function as an exit flow regenerator which recovers momentum and utilizes the recovered momentum to increase the flow velocity in the axial direction. In other words, flow in directions other than axial e.g. radially directed flow, is converted to axial flow, thereby increasing the velocity profile of the coolant leaving pump 18 and entering coolant intake port 14 on cylinder block 12.

Although the present invention has been described in connection with particular embodiments thereof, it is to be understood that various modifications, alterations, and adaptations may be made by those skilled in the art without departing from the spirit and scope of the invention. By way of example, the present coolant pump need not be mounted to an engine block, and could be located adjacent an engine within a common compartment. It is intended that the invention be limited only by the appended claims.

What is claimed is:

1. An internal combustion engine, comprising:

a cylinder block structure;

a coolant intake port formed in the cylinder block structure;

a radiator; and a liquid coolant pump mounted to said cylinder block structure, for moving coolant from said radiator and into said coolant intake port, with said coolant pump comprising:

an inlet connected with said radiator;

an axially-directed rotary pumping element for producing an axially-directed flow of coolant, with said rotary pumping element being attached to a sealed driveshaft;

an upstream transitional stator mounted proximate said rotary pumping element, between said pumping element and said inlet with said upstream transitional stator comprising a unitary structure having a plurality of curved vanes attached to a common hub and terminating in a common peripheral ring shroud; and a downstream flow straightening stator mounted proximate said rotary pumping element, between said pumping element and said coolant intake port.

2. An internal combustion engine according to claim 1, wherein said coolant pump is powered directly by the engine.

3. An internal combustion engine according to claim 1, wherein said coolant pump is powered by a drive belt connected between said driveshaft and a crankshaft of the engine.

4. An internal combustion engine according to claim 1, wherein said coolant pump is powered by a camshaft of the engine.

5. An internal combustion engine according to claim 1, wherein said coolant pump is powered by an electric motor connected to said driveshaft.

6. An internal combustion engine according to claim 1, wherein said coolant pump is powered by a hydraulic motor connected to said driveshaft.

7. An internal combustion engine according to claim 1, wherein said downstream flow straightening stator comprises a unitary structure having a plurality of curved vanes attached to a common hub and terminating in a common peripheral ring shroud.

8. An internal combustion engine according to claim 1, wherein said rotary pumping element comprises a unitary structure having a plurality of curved blades attached to a common hub and terminating in a common peripheral ring shroud.

9. An internal combustion engine according to claim 8, wherein said rotary pumping element comprises a metal stamping.

10. An internal combustion engine according to claim 8, wherein said rotary pumping element comprises a casting.

11. An internal combustion engine according to claim 8, wherein said rotary pumping element comprises a plastic composite.

12. An internal combustion engine according to claim 1, wherein said coolant pump further comprises a housing having a coolant inlet extending from the housing in a direction generally parallel to the axis of said driveshaft, with said housing having a mixed flow transition section extending between said inlet and said upstream transitional stator.

13. An internal combustion engine according to claim 1, wherein said coolant pump is mounted to the front of the engine above the engine's crankshaft.

14. A method for providing liquid coolant to an internal combustion engine, comprising the steps of:

drawing coolant from a radiator and into a coolant pump;

passing the coolant through a mixed flow transition section within the pump, thereby changing the flow from primarily a radially directed flow to primarily an axially directed flow;

passing the coolant through a transitional stator to increase the axially directed flow component;

performing work upon the coolant with an axially directed, rotary pumping element;

passing the coolant leaving the rotary pumping element through a flow regenerator to increase the axially directed flow component; and passing the coolant into a coolant intake port formed in a cylinder block structure.

15. A coolant pump for an internal combustion engine, comprising:

a housing having a coolant inlet;

an axially-directed propeller for producing an axially-directed flow of coolant, with said propeller having a plurality of curved blades extending between and attached to a common hub and to a common peripheral ring shroud;

a driveshaft extending from said housing, with said driveshaft having a first end for receiving a power transmission element and a second end terminating within the hub of said propeller, and with the driveshaft being sealingly journaled within the housing;

an upstream transitional shrouded stator mounted within the housing proximate said propeller, between said propeller and said inlet; and a downstream flow regenerating stator mounted within the housing proximate said propeller, between said propeller and an outlet flange of said housing, with said regenerating stator adapted to discharge coolant into an engine in an axially directed flow.

16. A coolant pump according to claim 15, wherein said propeller comprises a molded plastic composite.

17. A coolant pump according to claim 15, wherein said upstream and downstream stators comprise plastic composite structures.

* * * * *